US008286376B2

(12) United States Patent
Nikols

(10) Patent No.: US 8,286,376 B2
(45) Date of Patent: Oct. 16, 2012

(54) TRAY-TAG

(76) Inventor: Michael J. Nikols, Salt Lake City, UT (US)

( * ) Notice: Subject to any disclaimer, the term of this patent is extended or adjusted under 35 U.S.C. 154(b) by 0 days.

(21) Appl. No.: 12/965,625

(22) Filed: Dec. 10, 2010

(65) Prior Publication Data

US 2011/0132857 A1 Jun. 9, 2011

Related U.S. Application Data

(63) Continuation-in-part of application No. 12/187,216, filed on Aug. 6, 2008, now Pat. No. 7,874,088.

(51) Int. Cl.
*G09F 3/00* (2006.01)

(52) U.S. Cl. ..... 40/324; 40/658

(58) Field of Classification Search ..... 40/324, 40/658

See application file for complete search history.

(56) References Cited

U.S. PATENT DOCUMENTS 1,284,796 A * 11/1918 Sherer ..... 40/666
1,375,619 A * 4/1921 Vaughn ..... 40/313
1,826,037 A 10/1931 Allen
2,171,350 A * 8/1939 Anderson ..... 40/324
3,937,296 A 2/1976 Larson
3,943,838 A 3/1976 Price
3,946,654 A 3/1976 Janssen
3,960,369 A 6/1976 Sommer
3,962,569 A 6/1976 Loshbough et al.
3,962,570 A 6/1976 Loshbough et al.
3,981,855 A 9/1976 Klein
3,984,667 A 10/1976 Loshbough
3,986,012 A 10/1976 Loshbough et al.
3,993,319 A 11/1976 Day
4,004,139 A 1/1977 Hall
4,035,218 A 7/1977 Yount
4,044,485 A 8/1977 Hopp
4,052,934 A 10/1977 Shinman
4,065,595 A 12/1977 Schick et al.
4,074,003 A 2/1978 Schick et al.
4,074,004 A 2/1978 Bateson et al.
4,093,041 A * 6/1978 Davis et al. ..... 186/45
4,111,737 A 9/1978 Wesley
4,159,054 A 6/1979 Yoshida
4,163,066 A 7/1979 Mason et al.
4,163,684 A 8/1979 Kartanson
4,190,757 A 2/1980 Turpin et al.
4,194,680 A 3/1980 Scott et al.
4,194,681 A 3/1980 Scott et al.
4,200,319 A 4/1980 Cooper
4,207,102 A 6/1980 Dessauer
4,211,360 A 7/1980 Scott et al.
4,232,108 A 11/1980 Dessauer
4,232,597 A 11/1980 Perrine et al.

(Continued)

*Primary Examiner* — Casandra Davis
(74) *Attorney, Agent, or Firm* — Workman Nydegger

(57) ABSTRACT

A tray-tag that can be mounted on a tray and display information about items on the tray is provided. A tray-tag of the present invention includes a face plate having front and back surfaces. The front surface of the face plate is adapted to have indicia thereon that display information about the items on the tray. The tray-tag also includes a mounting assembly capable of selectively and securely coupling the tray-tag to a tray. The mounting assembly includes an engagement flap and first and second support tabs. The engagement flap and the support tabs securely couple the tray-tag to the tray. The engagement flap extends over a rim of the tray, while the support tabs extend underneath the rim to couple the tray-tag to the tray. Additionally, the support tabs maintain the face plate in a generally vertical orientation.

20 Claims, 7 Drawing Sheets

U.S. PATENT DOCUMENTS

| | | | |
|---|---|---|---|
| 4,232,920 | A | 11/1980 | Bukaitz |
| 4,257,388 | A | 3/1981 | McGuire |
| 4,273,318 | A | 6/1981 | Crowhurst |
| 4,284,058 | A | 8/1981 | Lütz |
| 4,295,915 | A | 10/1981 | Sakaguchi et al. |
| 4,301,544 | A | 11/1981 | Burton |
| 4,301,878 | A | 11/1981 | Soe |
| 4,302,204 | A | 11/1981 | Wahl et al. |
| 4,303,272 | A | 12/1981 | Berggren |
| 4,318,084 | A | 3/1982 | Scott et al. |
| 4,328,783 | A | 5/1982 | Martenson |
| 4,333,265 | A | 6/1982 | Arnold |
| 4,334,463 | A | 6/1982 | Goldie |
| 4,337,859 | A | 7/1982 | Murphy et al. |
| 4,357,881 | A | 11/1982 | De Long |
| 4,374,489 | A | 2/1983 | Robbins |
| 4,379,018 | A | 4/1983 | Griesdorn |
| 4,381,315 | A | 4/1983 | Yong et al. |
| 4,388,336 | A | 6/1983 | Yong et al. |
| 4,389,420 | A | 6/1983 | Yong et al. |
| 4,415,598 | A | 11/1983 | Chen et al. |
| 4,423,503 | A | 12/1983 | Cheeseboro |
| 4,442,824 | A | 4/1984 | Amici |
| 4,444,147 | A | 4/1984 | Dahlgren et al. |
| 4,457,748 | A | 7/1984 | Lattin et al. |
| 4,460,428 | A | 7/1984 | Teraoka |
| 4,517,617 | A | 5/1985 | Tsuji et al. |
| 4,523,305 | A | 6/1985 | Cheeseboro |

* cited by examiner

TRAY-TAG

CROSS-REFERENCE TO RELATED APPLICATIONS

This application is a continuation-in-part application of U.S. patent application Ser. No. 12/187,216, filed Aug. 6, 2008 now U.S. Pat. No. 7,874,088, entitled "TRAY-TAG," which is hereby incorporated herein by reference in its entirety

BACKGROUND OF THE INVENTION

1. Technical Field

Exemplary embodiments of the present invention relate generally to identification tags. More particularly, the invention relates to identification tags that can be securely mounted on or connected to a pan or tray to provide information about items on the pan or tray.

2. The Relevant Technology

Many businesses, including restaurants, hospitals, hotels, and schools, have large kitchens where varieties of foods are cooked or otherwise prepared. Before and after preparation, many of the foods are placed in storage units, such as refrigerators or food warmers. While stored, the foods are commonly placed on flat pans or trays, which, in turn, are placed in the storage units. The storage units commonly have multiple slots, shelves, or racks in which multiple trays can be placed. The slots, shelves, or racks can thus increase the organization and storage capacity of the storage units.

In an effort to maximize the storage capacity of the food storage units without increasing the overall size of the storage units, the slots, shelves, or racks within the storage units are commonly placed relatively close to one another. In addition to increasing the storage capacity of the storage unit, placing the slots, shelves, or racks relatively close together may also reduce the likelihood of other foods being spilled on or otherwise being undesirably mixed with the food on each tray. Specifically, when the trays are stacked relatively closely together within the storage unit, there is less open space between the shelves and trays through which other foods can undesirably enter. While stacking the trays relatively close together within a storage unit provides some benefits as described above, closely stacking trays also leads to some difficulties and inconveniences.

As is well known, care must be exercised when storing food to avoid contamination, spoilage, and the growth of pathogens that cause food borne illnesses. To avoid these problems, many state and local governments have provided detailed instructions and regulations relating to the proper storage of food. Some of these instructions include, for example, storing food in clean, dry places to prevent contamination from splash, dust, or other contaminates. Additionally, food should not be stored near the floor, chemicals, or cleaning products. Some regulations even require that foods be stored in specific orders relative to one another. For example, raw meat, poultry, fish, and eggs should be stored below prepared or ready to eat foods. Similarly, raw foods, including unwashed fruits and vegetables, should be kept away from ready to eat foods. Furthermore, some regulations require that foods be rotated periodically.

When numerous trays are stacked within the close slots of a storage unit, such as a refrigerator, it can be difficult to see what type of food is on each tray. For example, the relatively close positioning of the shelves and trays can block out light, thus making it difficult to see between the shelves and trays to identify what food is on each tray. Thus, in order to identify what type of food is on a specific tray, it may be necessary to at least partially withdraw the tray from the storage unit so that the food on the tray can be seen. Therefore, when retrieving a specific type of food from the storage unit, it may be necessary to withdraw multiple trays from the slots before the tray with the desired food is found. Likewise, when placing a tray of food into the storage unit, it may also be necessary to withdraw multiple trays to ascertain what type of food is on each tray so as to ensure that the new tray of food is properly placed within the storage unit relative to the other foods in the storage unit.

Furthermore, common food storage systems do not have a convenient system for keeping track of other types of information relating to food stored within the food storage system. For example, there is not a convenient way to label or otherwise associate information relating to the stored food, such as when the food needs to be rotated, at what temperature it should be stored or cooked, and the like. Thus, a user of a common food storage system must try to remember all the information relating to the stored food, maintain a log of what food is stored on each tray in addition to all the pertinent information relating to that food, or periodically check each tray to identify its contents and refer to other reference material for the appropriate information relating to that food.

What is needed, therefore, is a food storage labeling system that enables food to be properly stored while reducing or eliminating the drawbacks of common food storage systems.

BRIEF SUMMARY OF THE INVENTION

Exemplary embodiments of the present invention relate generally to identification tags for improving labeling of items. In particular, exemplary embodiments of the present invention include a tray-tag which can both display information and be selectively and securely coupled to a tray. The tray-tag thus provides a system for readily ascertaining the identity, as well as other pertinent information, about the contents of a tray.

In one embodiment, for example, a tray-tag can provide information about items on a tray to which the tray-tag is attached. In particular, the tray-tag can include a face plate that has a front surface and a back surface, the front surface being adapted to have indicia thereon to provide information about items placed on the tray. The indicia can be permanently placed or affixed on the face plate, or the indicia can be selectively and removably placed or affixed on the face plate. Further, the tray-tag can include a mounting assembly adapted to selectively and securely couple the tray-tag to a tray. The mounting assembly can have an engagement flap and one or more support tabs that cooperate to couple the tray-tag to the rim of a tray. The face plate of the tray-tag can be maintained in a generally vertical position when the tray-tag is coupled to a tray by the one or more support tabs.

In other embodiments of the present invention, a tray-tag includes a face plate upon which indicia can be placed for providing information about items on the tray. Additionally, the tray-tag can include a mounting assembly positioned on a back surface of the face plate for coupling the tray-tag to a tray. The mounting assembly can include means for coupling the tray-tag to the tray, and means for preventing rotation of the tray-tag relative to the tray. The means for coupling can enable selective coupling and decoupling between the tray-tag and the tray.

In some embodiments, the means for coupling and the means for preventing rotation are the same means. Further, the means for coupling can include an engagement flap that extends over a top portion of a rim of a tray and down at least a portion of a wall of the tray. Similarly, the means for coupling can include first and second support tabs that extend underneath a bottom portion of the rim of the tray. In one embodiment, the engagement flap is positioned between the means for preventing rotation.

According to yet another exemplary embodiment of the present invention, a food storage system is provided for increasing the organization of stored food. The food storage system can include a shelving assembly with multiple slots for receiving trays of food therein. The system can also include a plurality of tray-tags for providing information about the food on each tray. Each of the tray-tags is adapted to be coupled to a tray to provide information about the food on that tray. Each of the tray-tags can include a face plate and a mounting assembly. The face plate of each tray-tag can display indicia relating to information about the food on the tray associated with the tray-tag. Optionally, each of the tray-tags of the system can be adapted to maintain its face plate in a generally vertical orientation when the tray-tag is coupled to one of the plurality of trays. Additionally, the tray-tags can be formed of a dishwasher safe material so that the tray-tag can remain attached to the tray when the tray is washed in a dishwasher.

According to another exemplary embodiment, a tray-tag is provided that can be selectively and securely coupled to a rim of a tray for providing information about items on the tray. The tray-tag includes a face plate and a mounting assembly. The face plate has front and back surfaces, the front surface being adapted to have indicia thereon for providing information about items on the tray. The mounting assembly extends from the face plate and includes an engagement flap and a first support tab. The mounting assembly selectively and securely couples the tray-tag to the rim of the tray so that the rim of the tray is positioned adjacent to the face plate and generally within a horizontal projection of the face plate when the tray-tag is coupled to the tray.

According to some embodiments, the engagement member extends from a top surface of the face plate, while in other embodiments the engagement member extends from the back surface of the face plate. Similarly, in some embodiments the first support tab extends from a bottom surface of the face plate, while in other embodiments the first support tab extends from the back surface of the face plate.

The engagement flap and the first and second support tabs can form a discontinuous channel along the back surface of the face plate. The discontinuous channel can have a central longitudinal axis that is generally aligned with a central longitudinal axis of the rim of the tray when the tray-tag is coupled to the tray. In some embodiments, the discontinuous channel formed by the engagement flap and the first and second support tabs has a cross-sectional geometry that generally corresponds to a cross-sectional geometry of the rim of the tray.

In still yet another exemplary embodiment, a tray-tag includes a face plate having front and back surfaces, the front surface being adapted to have indicia thereon for providing information about items on a tray. The tray-tag also includes a mounting assembly associated with the face plate and being configured to selectively and securely couple the face plate to the rim of the tray. The mounting assembly has a central longitudinal axis that is substantially within a horizontal projection of the face plate when the face plate is in a generally vertical orientation. The mounting assembly includes an engagement flap that extends distally from the face plate so as to extend over a top of the rim of the tray when the tray-tag is selectively coupled to the tray. The mounting assembly also includes at least one support tab that extends distally from the face plate so as to extend underneath the rim of the tray. The at least one support tab is adapted to substantially prevent the face plate from rotating about the rim of the tray. In some embodiments, the engagement flap and the first support tab are disposed substantially within the horizontal projection of the face plate when the face plate is in a generally vertical orientation.

Another exemplary embodiment of the present invention is directed to a food storage system that includes a shelving assembly, a plurality of trays, and a plurality of tray-tags. The shelving assembly has a plurality of shelves arranged to form a plurality of slots therebetween. The plurality of trays can have food placed therein. Each of the plurality of trays can be received within one of the plurality of slots of the shelving assembly. Additionally, each of the plurality of trays includes a base, a wall extending from the base, and a rim formed on the wall. Each of the tray-tags has a face plate and a mounting assembly. The mounting assembly of each tray-tag is adapted to couple the face plate to a rim of a tray. The mounting assembly is arranged on the face plate such that the rim of the tray to which the tray-tag is coupled is substantially disposed within a horizontal projection of the face plate to enable the tray and the tray-tag to be received within one of the plurality of slots without the tray-tag engaging one or more of the plurality of shelves. The mounting assembly includes one or more support tabs that substantially prevent rotation of the face plate about the rim of the tray.

According to one embodiment, the mounting assembly includes an engagement flap that extends over a top surface of the rim of the tray. Additionally, at least one of the engagement flap and the one or more support tabs extend from a back surface of the face plate and at least one of the engagement flap and the one or more support tabs extend from a top or bottom surface of the face plate.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Exemplary embodiments of the present invention relate generally to identification tags. More particularly, the invention relates to identification tags that can be securely mounted on or connected to a pan or tray to provide information about items on the pan or tray.

Through the practice of the invention, a user is presented with a wide variety of options for labeling and organizing foods stored in a storage unit, such as a refrigerator or food warmer. A tray-tag may be provided, for example, which is configured to be quickly and easily attached to or otherwise mounted on a tray or pan. When the tray-tag is attached to the tray or pan, it becomes an integrated part of a food storage system.

Further, the tray-tag may be configured to remain attached to the tray or pan. For example, the tray-tag may be formed of a dishwasher safe material so that the tray or pan along with the attached tray-tag can be washed together in a dishwasher. Further still, the tray-tag can be selectively removed from one tray or pan and attached to another tray or pan.

Moreover, the tray-tag can include a labeling surface that can have an information-bearing label, such as a sticker, attached thereto. Additionally, or alternatively, the labeling surface can have information written directly thereon. For example, a user can use a permanent or semi-permanent marker to write information on the labeling surface. Information on an attached label or written on the labeling surface may include the type of food on the tray, when the food was made, when the food was placed in the storage unit, the quantity of food on the tray, the identity of the food manufacturer, and the like. In this manner, the tray-tag may be used to convey information about the food stored on the tray or pan associated with the tray-tag.

Reference will now be made to the drawings to describe various aspects of exemplary embodiments of the invention. It is understood that the drawings are diagrammatic and schematic representations of such exemplary embodiments, and are not limiting of the present invention, nor are they necessarily drawn to scale. In the following description, numerous specific details are set forth in order to provide a thorough understanding of the present invention. It will be obvious, however, to one of ordinary skill in the art that the present invention may be practiced without these specific details. In other instances, well-known aspects of food storage systems have not been described in particular detail in order to avoid unnecessarily obscuring the present invention.

Figure 1:
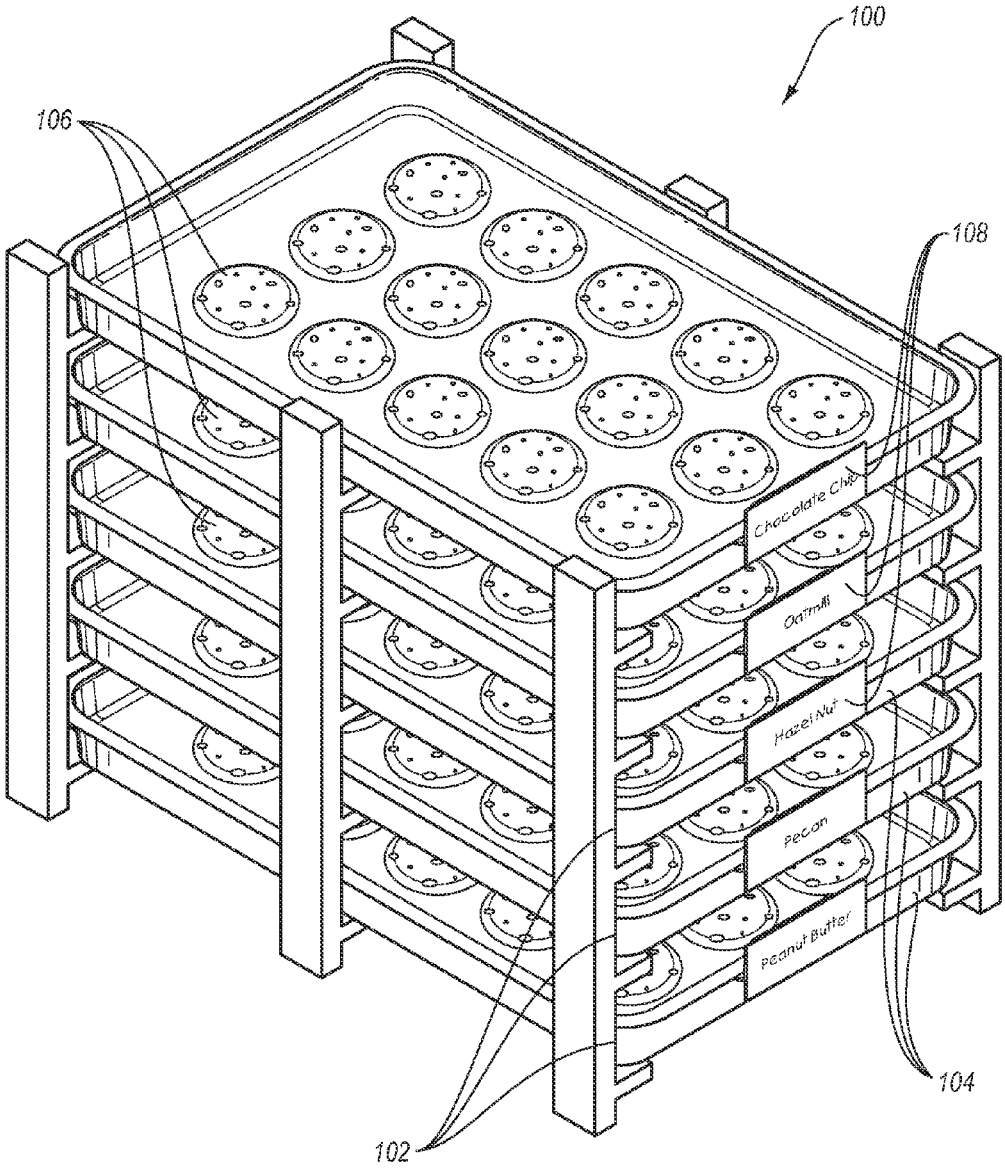
FIG. 1 illustrates a food storage system with multiple trays stacked therein, with each tray having a tray-tag attached thereto to display information about the food on each tray.

FIG. 1 illustrates an exemplary food storage system 100. In particular, food storage system 100 includes a plurality of slots. Each slot 102 is adapted to receive a tray 104 therein. Each tray 104 may have food 106 placed thereon for storage in food storage system 100. Food storage system 100 may be positioned within another food storage device, such as a refrigerator or food warmer. Alternatively, food storage system 100 may be positioned separate from any other food storage device. Furthermore, food storage system 100 includes tray-tags 108 attached to trays 104. Each tray-tag 108 is securely attached to an edge of a tray 104.

Tray-tags 108 may include indicia thereon to identify information about the food 106 on each tray 104. For example, each tray-tag 108 can include indicia that identifies the type of food 106 on each tray 104, the appropriate storage temperature for food 106, the quantity of food 106, and the like. Additionally, each tray-tag 108 can include indicia that identify the producer, distributer, and the like of the food on each tray 104, thereby becoming a means of advertising for the particular producer, distributer, and the like. Thus tray-tags 108 can provide information to enable ready and convenient inventory audits, proper storage of food 106, including placement and rotation of food 106, advertising information for a particular food producer or distributer, and the like.

As illustrated in FIG. 1, utilization of food storage system 100 provides for increased storage capacity by allowing multiple trays 104 to be stacked or otherwise placed one above another. Therefore, rather than placing trays 104 side-by-side on a counter or table to store food 106, trays 104 can be placed within slots 102 one above another, thereby reducing the overall storage footprint of trays 104. Food storage system 100 thus frees up counter or table space that would otherwise be taken up by trays 104.

Figure 2:
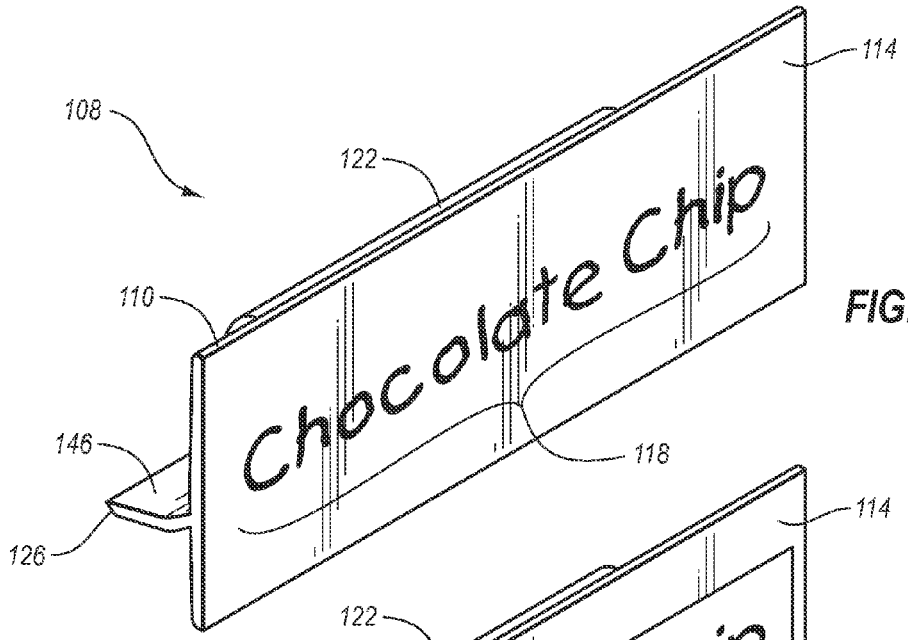
FIG. 2 is a front perspective view of a tray-tag having indicia written thereon.
Figure 3:
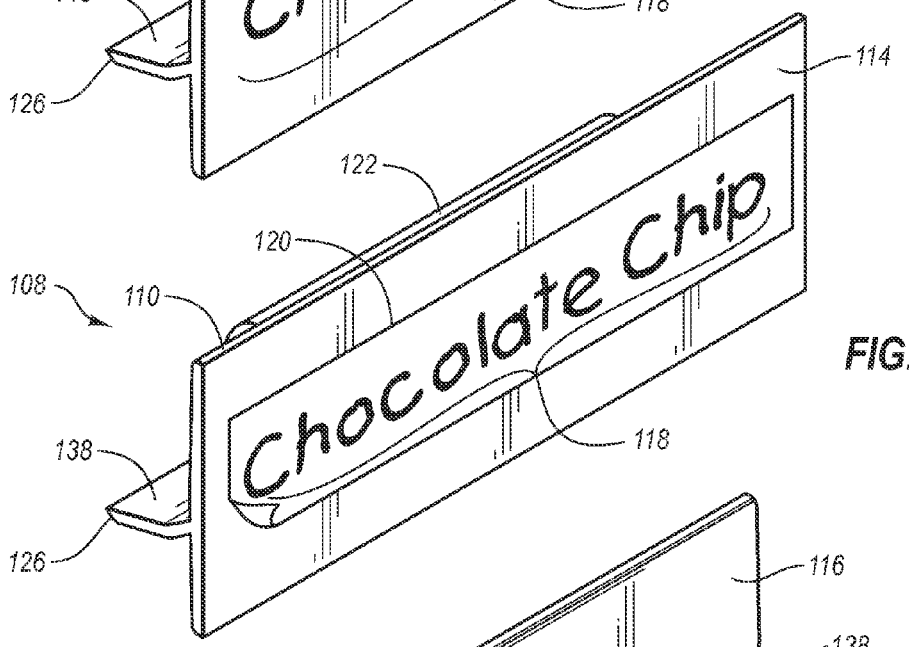
FIG. 3 is a front perspective view of a tray-tag having a label attached thereto.

With reference to FIGS. 2-6, various aspects and features of tray-tag 108 will now be described. In the illustrated embodiment, tray-tag 108 includes a face plate 110 and a mounting assembly 112. Face plate 110 has a front surface 114 and a rear surface 116. As illustrated in FIGS. 2 and 3, front surface 114 is adapted to have indicia 118 placed thereon. Indicia 118 can be placed on front surface 114 by any suitable means. By way of example, and not limitation, indicia 118 can be written on front surface 114, applied by way of a label, such as a sticker 120, stamped on or into front surface 114, or formed with indicia 118 thereon, such as through a molding process.

Indicia 118 can include information regarding food 106 on tray 104. By way of example, and not limitation, indicia 118 can identify the producer, distributor, or the like of the food on tray 104, the type of food on tray 104, when the food was prepared, and the proper storage temperature for the food. Additionally, indicia 118 can also indicate when to rotate or discard the food, the appropriate cooking temperature for the food, and the like. In light of the disclosure herein, it will be appreciated that indicia 118 can include any relevant information relating to food 106 on tray 104. Moreover, tray-tag 108, and more specifically face plate 110, can be sized to accommodate multiple indicia 118 thereon. Specifically, indicia 118 can include combinations of the above-identified types of information as well as other types of information relating to food 106. For example, tray-tag 108 can include a logo or other indicia that identifies the maker of food 106, as well as specific information relating to food 106, such as its type, cooking instructions, storage instruction, nutritional information, and the like. Additionally, a single tray-tag 108 can include indicia 118 in multiple languages, such as English and Spanish.

Face plate 110, and specifically front surface 114 of face plate 110, can be formed so that indicia 118 can be permanently placed thereon. For example, face plate 110 can be formed with indicia 118 engraved, stamped, or otherwise molded in or onto face plate 110 so that indicia 118 is permanently on face plate 110. Additionally, indicia 118 can be permanently applied to face plate 110 after face plate 110 has been formed. For example, indicia 118 can be applied to face plate 110 by way of a permanent marker (FIG. 2) or a permanent label or sticker 120 (FIG. 3). Thus, for example, a tray-tag 108 can be dedicated to use with a specific type of food 106.

Additionally, or alternatively, face plate 110, and specifically front surface 114 of face plate 110, can be formed so that indicia 118 can be selectively and semi-permanently placed thereon or removed therefrom. For example, indicia 118 can be applied to front surface 114 with a semi-permanent marker (FIG. 2), such as a dry-erase marker, or a removable label or sticker 120 (FIG. 3). In this manner, tray-tag 108 can be reused with different foods and relabeled with information or indicia 118 relating to that specific food.

Moreover, tray-tags 108 can be color-coded to provide information about food 106 on each tray 104. In particular, trays 104 that hold similar types of food can be identified with tray-tags 108 of a specific color, while trays 104 that hold different types of food can be identified with tray-tags 108 of different colors. By way of example, and not limitation, trays 104 that hold fish products can have green tray-tags 108 coupled thereto, while trays 104 that hold poultry products can have blue tray-tags 108 coupled thereto. Color-coding tray-tags 108 in this manner can provide numerous benefits. For example, color-coded tray-tags can facilitate ready and proper sorting, organization, storage, and the like of various types of food. Tray-tags 108 can be colored in any suitable manner. For example, the tray-tag 108 can be impregnated, coated, or formed with a colored material. Additionally, indicia 118 or label 120 can be color-coded to provide the same benefits.

Figure 4:
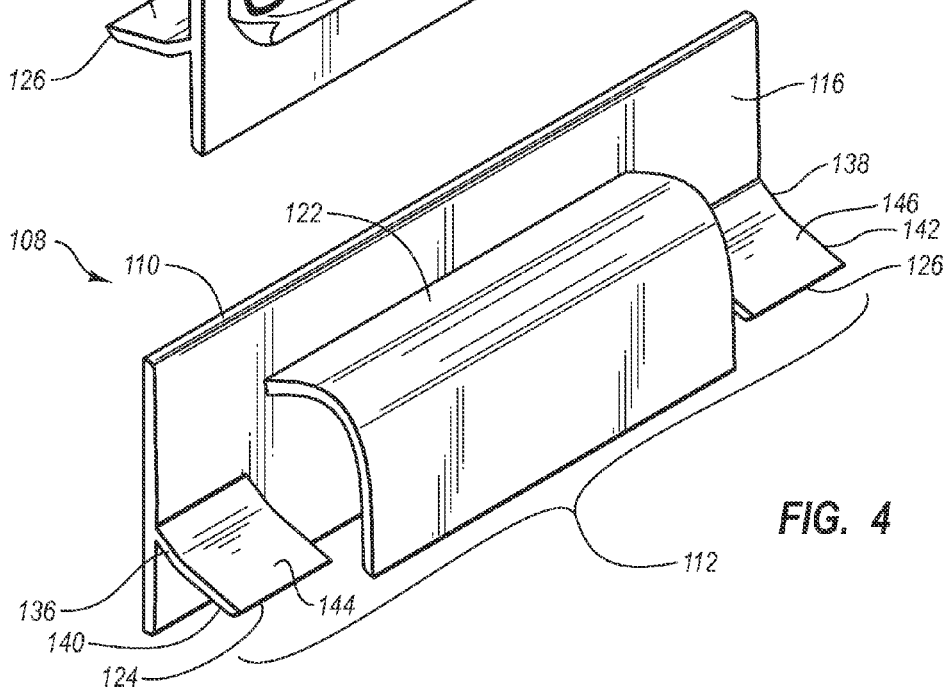
FIG. 4 is a rear perspective view of the tray-tag of FIG. 2.

With specific reference to FIGS. 4-6, mounting assembly 112 will now be described. In the illustrated embodiment, mounting assembly 112 includes an engagement flap 122, a first support tab 124, and a second support tab 126. Engagement flap 122 and first and second support tabs 124, 126 cooperate to securely couple tray-tag 108 to tray 104. Additionally, engagement flap 122 and first and second support tabs 124, 126 enable tray-tag 108 to be selectively attached to and removed from tray 104.

In the illustrated embodiment, engagement flap 122 is an elongated flap that extends at least partially along the length of tray-tag 108. Further, engagement flap 122 includes a first portion 128 and a second portion 130. In the presently illustrated embodiment, first portion 128 of engagement flap 122 extends from back surface 116 so as to be able rest on top of a rim 132 of tray 104 when tray-tag 108 is coupled to tray 104. Accordingly, and as illustrated, engagement flap 122 extends distally away from face plate 110. That is, a portion of engagement flap 122 is coupled to or is in contact with face plate 110 and another portion of engagement flap 122 is positioned distally away from face plate 110. Second portion 130 extends from first portion 128 in a generally downward direction toward the distal ends of support tabs 124, 126. Additionally, second portion 130 extends downwardly so as to extend at least partially down an interior surface of a tray wall 134. Thus, as illustrated in FIG. 6, engagement flap 122 is shaped to generally conform to the shape of the top portion of rim 132 and tray wall 134.

Figure 5:
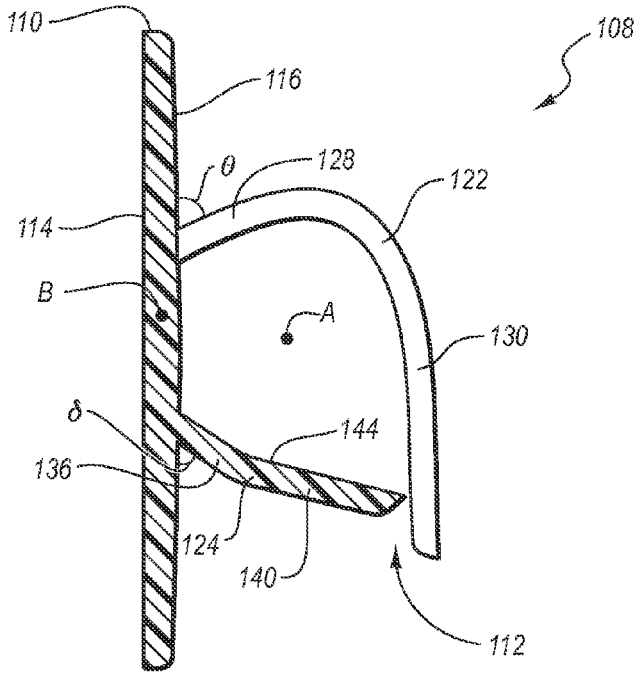
FIG. 5 is a partial cross-sectional end view of the tray-tag of FIG. 2.

While not necessary, the distal end of second portion 130 can extend vertically below the distal ends of support tabs 124, 126 when tray-tag 108 is not attached to tray 104, as illustrated in FIG. 5. This configuration helps tray-tag 108 to securely connect to tray 104. In particular, when tray-tag 108 is connected to tray 104, engagement flap 122 is flexed away from face plate 110, thereby raising the distal end of engagement flap 122. However, because of the length of engagement flap 122, the distal end of engagement flap 122 remains vertically adjacent to the distal ends of support tabs 124, 126, even when tray-tag 108 is attached to tray 104. As seen in FIG. 6, the relatively close positioning of the distal ends of engagement flap 122 and support tabs 124, 126 creates a passageway between engagement flap 122 and support tabs 124, 126 that is about the width of tray wall 134. The relatively narrow passageway prevents the relatively larger rim 132 of tray 104 from being undesirably removed through the passageway. Thus, engagement flap 122 and support tabs 124, 126 cooperate to securely attach tray-tag 122 to tray 104. Engagement flap 122 and support tabs 124, 126 are, thus, individually and collectively, examples of means for coupling tray-tag 108 to tray 104.

In the example embodiment, first portion 128 extends from face plate 110 at an angle θ relative to face plate 110. While angle θ in the illustrated embodiment is about 65 degrees, it will be appreciated that angle θ can be more or less than 65 degrees. Accordingly, while first portion 128 can, but is not required to, make a 90 angle with face plate 110, engagement flap 122 may still be considered to extend generally perpendicularly from face plate 110.

It will also be appreciated that first portion 128 can extend from a variety of places on back surface 116. In the illustrated embodiment, first portion 128 extends from an upper region of back surface 116. However, first portion 128 can extend from a center or a lower region of back surface 116. In some embodiments, the angle θ and the position on back surface 116 from which first portion 128 extends are dependent on one another, as well as the positions of support tabs 124, 126. For example, assuming support tabs 124, 126 are positioned as illustrated, if first portion 128 extends from a center or a lower portion of back surface 116, the angle θ may be less than that illustrated in FIG. 6 so as to enable first portion 128 to extend up and over rim 132. Likewise, assuming support tabs 124, 126 are positioned as illustrated, if first portion 128 extends from a position vertically higher that that illustrated, the angle θ may be greater than that illustrated in FIG. 6 so as to enable first portion 128 to extend down to rim 132. Therefore, the angle θ can be determined so that the shape and positioning of engagement flap 122 generally corresponds to the shape and positioning of rim 132 of tray 104.

As noted above, mounting assembly 112 includes first and second support tabs 124, 126 separated by engagement flap 122. More specifically, the illustrated embodiment of first and second support tabs 124, 126 extend from opposing ends of back surface 116 while engagement flap 122 is centrally located along the length of tray-tag 108. Additionally, support tabs 124, 126 are longitudinally spaced apart from engagement flap 122 to facilitate ready attachment and detachment between tray-tag 108 and tray 104, as will be described in greater detail below.

Support tab 124, 126 have first portions 136, 138, respectively, and second portions 140, 142, respectively. Further, each support tab 124, 126 has a respective top surface 144, 146. First portions 136, 138 extend out and slightly downward from back surface 116 so as to extend underneath rim 132 of tray 104. That is, a portion of first portions 136, 138 are coupled to or are in contact with face plate 110 while another portion of first portions 136, 138 are disposed distally away from face plate 110. Second portions 140, 142 extend from first portions 136, 138 at an angle slightly more perpendicular relative to face plate 110 than first portions 136, 138. Thus, as illustrated in FIG. 6, support tabs 124, 126 are shaped to generally conform to the bottom portion of rim 132 of tray 104.

In the example embodiment, first portions 136, 138 of support tabs 124, 126 extend from face plate 110 at an angle δ relative to face plate 110. While angle δ in the illustrated embodiment is about 55 degrees, it will be appreciated that angle δ can be more or less than 55 degrees. Accordingly, while first portions 136, 138 can, but are not required to, make a 90 angle with face plate 110, support tabs 124, 126 may still be considered to extend generally perpendicularly from face plate 110.

It will also be appreciated that first portions 136, 138 can extend from a variety of places on back surface 116. In the illustrated embodiment, first portions 136, 138 extend from a lower region of back surface 116. However, first portions 136, 138 can extend from a center or an upper region of back surface 116. In some embodiments, the angle δ and the position on back surface 116 from which first portions 136, 138 extend are dependent on one another, as well as the position of engagement flap 122. For example, assuming engagement flap 122 is positioned as illustrated, if first portions 136, 138 extend from a center or an upper region of back surface 116, the angle δ may be less than that illustrated in FIG. 6 so as to enable support tabs 124, 126 to extend down underneath rim 132. Likewise, as discussed in greater detail below with regard to FIGS. 9-10, assuming engagement flap 122 is positioned as illustrated, if first portions 136, 138 extend from a region vertically lower than that illustrated, the angle δ may be greater than that illustrated in FIG. 6 so as to enable support tabs 124, 126 to extend up to rim 132. Therefore, the angle δ is determined so that top surfaces 144, 146 of support tabs 124, 126 generally corresponds to the shape and positioning of the bottom portion of rim 132 of tray 104.

Engagement flap 122 and support tabs 124, 126 cooperate to form a discontinuous channel along at least a portion of the length of tray-tag 108. More specifically, support tabs 124, 126 form two distinct lower channel regions separated by engagement flap 122, which forms an elongated upper channel region. Thus, when viewed from an end, as illustrated in FIGS. 5 and 6, engagement flap 122 and support tabs 124, 126 appear to form a channel in which a rim 132 of a tray 104 may be received.

The channel formed by engagement flap 122 and support tabs 124, 126 has a longitudinal axis A. Longitudinal axis A of the channel is collinear or generally parallel to a longitudinal axis of mounting assembly 112. Thus, illustrated axis A may be the longitudinal axis of the channel formed by engagement flap 122 and support tabs 124, 126, the longitudinal axis of mounting assembly 112, or both. Additionally, rim 132 may also have a longitudinal axis that is collinear or substantially parallel to axis A when tray-tag 108 is mounted on tray 104. Thus, illustrated axis A may also be the longitudinal axis of rim 132.

The discontinuous channel formed by engagement flap 122 and support tabs 124, 126 enables tray-tag 108 to be selectively and securely coupled to tray 104, as will be described in greater detail below. Additionally, the discontinuous channel nature of mounting assembly 118 also maintains face place 110 in a generally vertical orientation when tray-tag 108 is attached to tray 104. In other words, when tray-tag 108 is attached to tray 104, engagement flap 122 and support tabs 124, 126 cooperate to limit rotation of tray-tag 108 on rim 132, thereby maintaining face plate 110 in a generally vertical orientation. Thus, when tray-tag 108 is attached to tray 104, face plate 110 is positioned so that indicia 118 can be easily seen.

Figure 6:
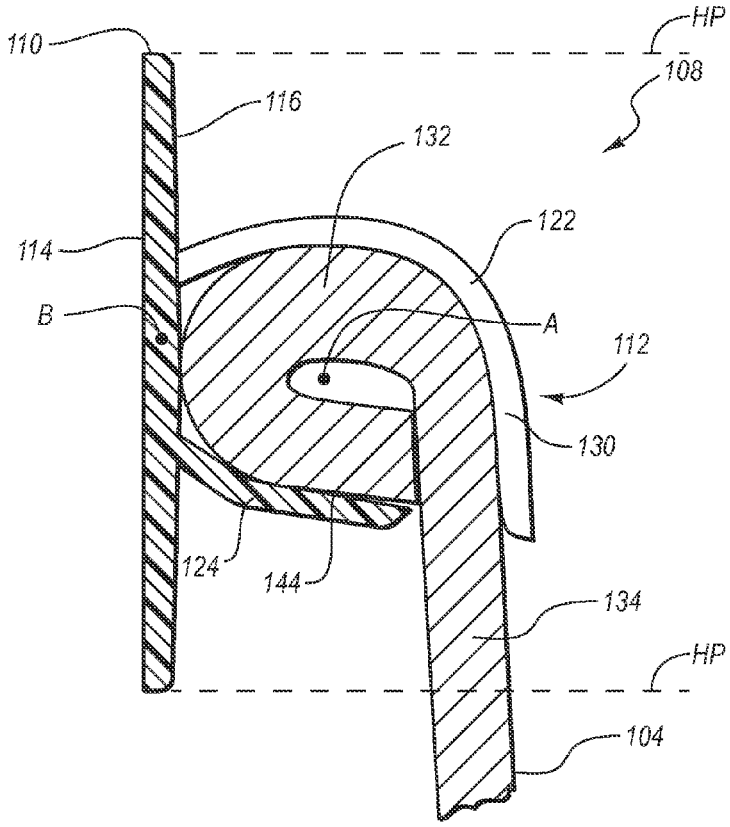
FIG. 6 is a partial cross-sectional end view of the tray-tag of FIG. 2 with the tray-tag attached to a tray.

For example, with reference to FIG. 6, to rotate tray-tag 108 so that front surface 114 begins to face upwardly (e.g., clockwise rotation of tray-tag 108), engagement flap 122 has to flex away from face plate 110. Flexing of engagement flap 122 away from face plate 110 will cause resistance to the rotating motion of tray-tag 108. Similarly, to rotate tray-tag 108 so that front surface 114 begins to face downwardly (e.g., counterclockwise rotation of tray-tag 108), support tabs 124, 126 have to flex toward face plate 110. Flexing of support tabs 124, 126 toward face plate 110 will cause resistance to the rotating motion of tray-tag 108. Additionally, if tray-tag 108 were rotated so that front surface 114 began to face downwardly (e.g., counterclockwise rotation of tray-tag 108), the distal ends of support tabs 124, 126 would engage either rim 132 or wall 134 of tray 104, thereby hindering further rotation of tray-tag 108. Thus, engagement flap 122 and support tabs 124, 126 cooperate to limit rotation of tray-tag 108 on rim 132 and thus help maintain the generally vertical orientation of face plate 110. Engagement flap 122 and support tabs 124, 126, individually and collectively, are thus examples of means for preventing rotation of tray-tag 108 relative to tray 104.

Mounting assembly 112 can extend from or be positioned on face plate 110 so that face plate 110 will be desirably positioned relative to rim 132 when tray-tag 108 is coupled to tray 104. For instance, as discussed herein, it may be desirable for face plate 110 not to extend to far above or below rim 132. Accordingly, mounting assembly 112 may be arranged on face plate 110 so that face plate 110 is positioned immediately adjacent rim 132. This can be accomplished by positioning mounting assembly 112 on face plate 110 so that mounting assembly 112 (or a central longitudinal axis of mounting assembly 112) is substantially within a generally horizontal projection of face plate 110 when face plate 110 is in a generally vertical orientation. As illustrated in FIG. 6, for example, mounting assembly 112 (and longitudinal axis A thereof) is positioned between horizontal projection lines HP of face plate 110. As a result, face plate 110 is held immediately adjacent to and generally vertically aligned with rim 132 so that face plate 110 does not extend too far above or below rim 132.

In the illustrated embodiment, tray-tag 108 is formed as a monolithic piece of material. However, tray-tag 108 can also be formed of multiple pieces that are joined together. For example, face plate 110, engagement flap 122, and support tabs 124, 126 can be individually formed and thereafter joined together. In such case, face plate 110, engagement flap 122, and support tabs 124, 126 can be joined by any suitable method, including with a mechanical fastener (e.g., brad, tack, or clip), an adhesive (e.g., glue or epoxy resin), and the like.

Furthermore, tray-tag 108 can be formed of any suitable material. As described below, to facilitate ready attachment and detachment of tray-tag 108 to and from tray 104, it is desirable that tray-tag 108 be formed of a firm, yet flexible and resilient material. Furthermore, it may be desirable for tray-tag 108 to be able to withstand high or low temperatures so that tray-tag 108 can remain attached to tray 104 when tray 104 is placed in a dishwasher, food warmer, refrigerator, or freezer, for example. Therefore, by way of example and not limitation, tray-tag 108 can be formed of various types of plastics, metals, alloys, ceramics, composites (e.g., glass, carbon fiber), organic materials, and the like.

Figure 7:
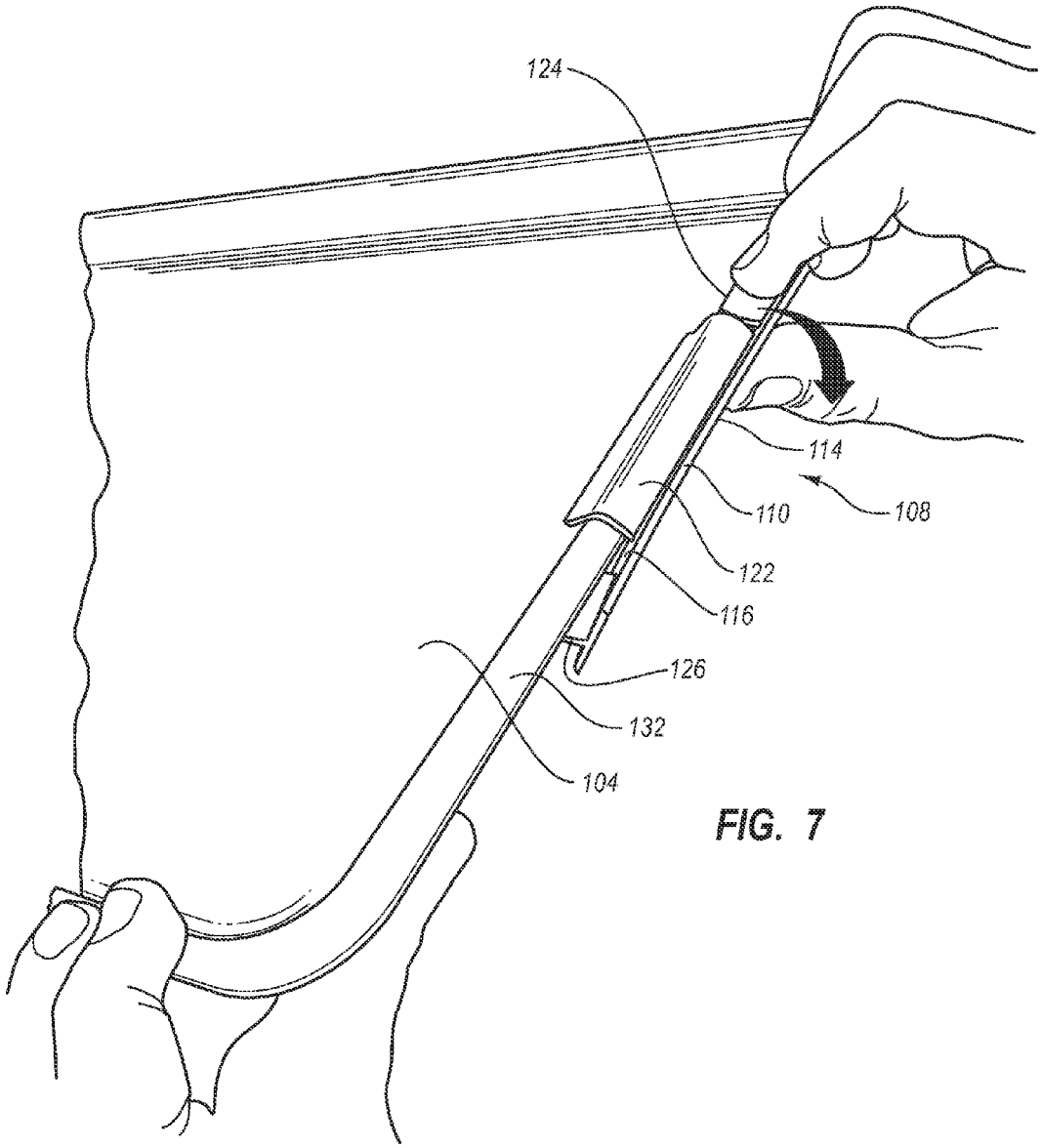
FIG. 7 illustrates the tray-tag of FIG. 2 being attached to a tray.
Figure 8:
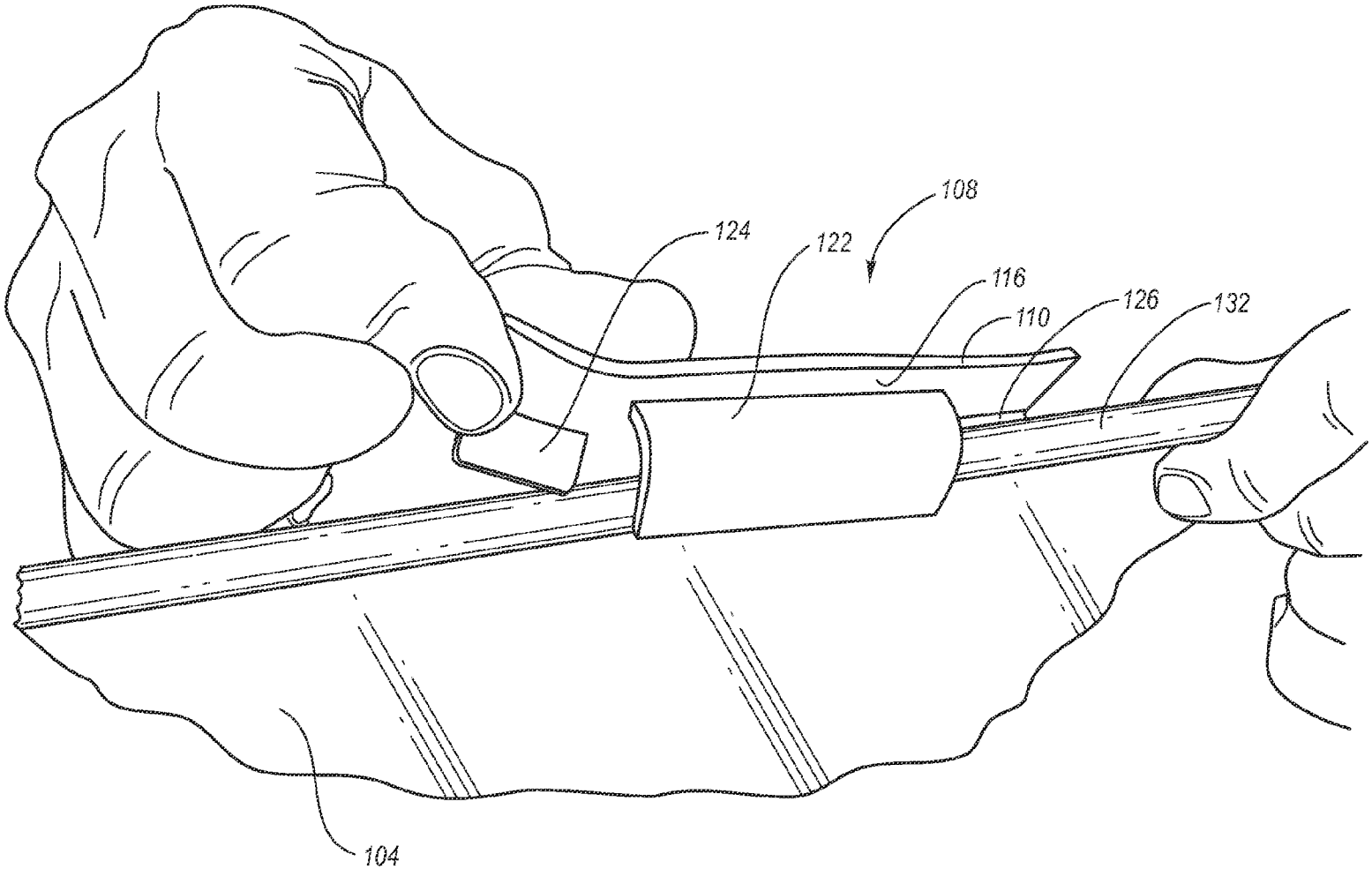
FIG. 8 illustrates another view of the tray-tag of FIG. 2 being attached to a tray.

With reference to FIGS. 7 and 8, a manner for attaching tray-tag 108 to tray 104 will now be described. To attach tray-tag 108 to tray 104, engagement flap 122 is positioned over the top of rim 132 and support tabs 124, 126 are positioned under rim 132. However, due to the relative positioning of engagement flap 122 and support tabs 124, 126, which creates the discontinuous channel described above, rim 132 of tray 104 cannot simply be inserted between engagement flap 122 and support tabs 124, 126. Rather, one of support tabs 124, 126 is initially positioned, followed by positioning of engagement flap 122. To complete the attachment of tray-tag 108, the other one of support tabs 124, 126 is positioned.

A more detailed process for attaching tray-tag 108 to tray 104 follows below. While the following process describes three sequential steps for attaching tray-tag 108 to tray 104, it will be appreciated that tray-tag 108 can be attached to tray 104 by reversing the described process steps. Additionally, while only one method for attaching tray-tag 108 to tray 104 is described, other methods of attachment are contemplated within the scope of the invention.

FIGS. 7 and 8 illustrate an exemplary method for attaching tray-tag 108 to tray 104. To begin attaching tray-tag 108 to tray 104, rim 132 is inserted between support tab 126 and engagement flap 122. This can be accomplished by holding tray-tag 108 at an angle relative to rim 132 and allowing a corner of engagement flap 122 to extend over rim 132. With engagement flap 122 so positioned, support tab 126 can be properly positioned underneath rim 132. To facilitate placement of support tab 126 underneath rim 132, the end of tray-tag 108 that includes support tab 126 can be flexed away from tray 104 to allow support tab 126 to snap underneath rim 132, as illustrated in FIG. 7. Once support tab 126 is properly positioned underneath rim 132, the end of tray-tag 108 that includes support tab 124 can be rotated down toward rim 132. With tray-tag 108 rotated down so that a bottom surface of support tab 124 is just above rim 132, the end of tray-tag 108 that includes support tab 124 can be flexed away from rim 132 to allow support tab 124 to snap underneath rim 132, as illustrated in FIGS. 7 and 8. This process properly positions support tabs 124, 126 underneath rim 132 and engagement flap 122 over the top of rim 132. So positioning tray-tag 108 on tray 104 ensures a secure attachment between tray-tag 108 and tray 104.

With tray-tag 108 mounted on or coupled to tray 104 as described herein, face plate 110 will be positioned adjacent to rim 132. For instance, as illustrated in FIG. 6, face plate 110 is positioned relative to rim 132 so that a longitudinal axis B of face plate 110 is generally vertically aligned with longitudinal axis A of rim 132. Thus, axis B of face plate 110 may be generally vertically aligned with and horizontally offset from axis A of rim 132 when tray-tag 108 is mounted on tray 104. As a result, face plate 110 can be positioned and held immediately next to rim 132 so that face plate 110 does not extend significantly above or below rim 132. This allows for tray 104 to be inserted into a slot 102 without tray-tag 108 being knocked off or interfering with slot 102 or doors of food storage system 100

As will be appreciated, the above-described process for mounting tray-tag 108 on tray 104 can be reversed to remove tray-tag 108 from tray 104. Specifically, one of support tabs 124, 126 can be removed from underneath rim 132 by flexing the end of tray-tag 108 away from rim 132. With one of support tabs 124, 126 free, tray-tag 108 can be rotated until rim 132 can be easily removed from between engagement flap 122 and the other of support tabs 124, 126.

Figure 9:
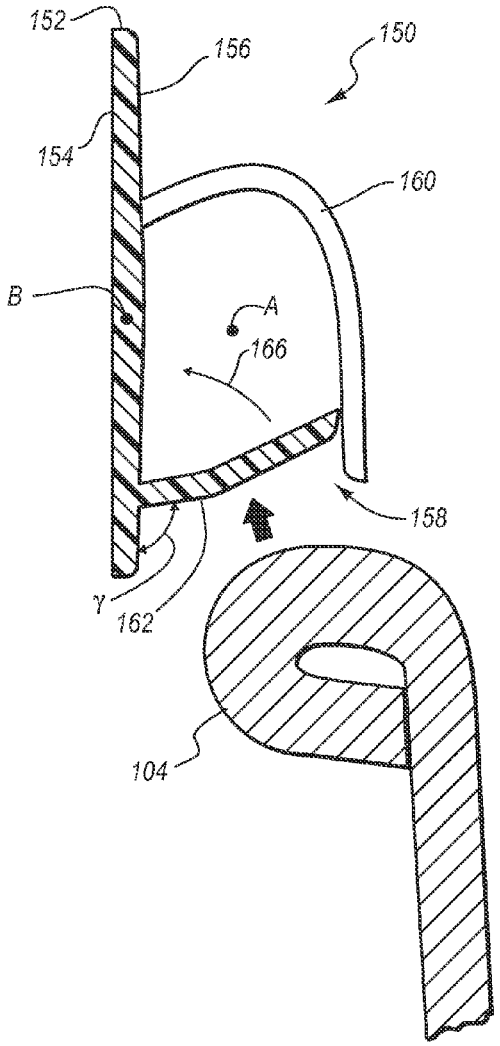
FIG. 9 is a partial cross-sectional end view of an alternative embodiment of a tray-tag according to the present invention.
Figure 10:
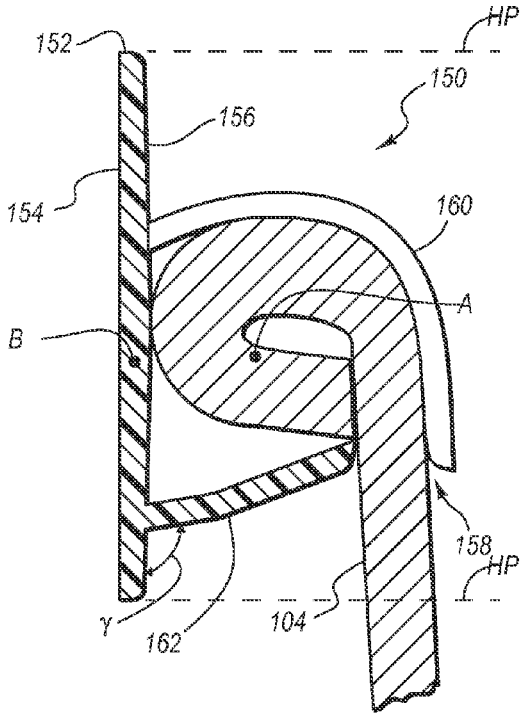
FIG. 10 is a partial cross-sectional end view of the tray-tag of FIG. 9 with the tray-tag attached to a tray.

As noted above, the position and orientation of support tabs 124, 126 on back surface 116 can be altered without departing from the scope of the present invention. FIGS. 9 and 10 illustrate an alternative embodiment of a tray-tag according to the present invention. Similar to tray-tag 108, tray-tag 150 includes a face plate 152 having a labeling surface 154 and a back surface 156. Labeling surface 154 can include indicia thereon for providing information about items placed on a tray 104 associated with tray-tag 150. Attached or extending from back surface 156 is a mounting assembly 158.

In the embodiment illustrated in FIGS. 9 and 10, mounting assembly 158 includes an engagement flap 160 and support tabs 162, 164 that are similar to engagement flap 122 and support tabs 124, 126, as described above. Support tabs 162, 164 extend from back surface 156 of face plate 152 at an angle γ relative to back surface 156. As described above with respect to the embodiment illustrated in FIGS. 5 and 6, support tabs 124, 126 can extend from a vertically central region of face plate 110 at an acute angle δ such that the support tabs 124, 126 extend downwardly from the back surface 116 of the tray-tag 108 to extend underneath rim 132 of tray 104. As noted above, however, the support tabs can be attached at or extend from various regions of or at various angles relative to the face plate.

For example, as illustrated in FIGS. 9 and 10, support tabs 162, 164 can be attached to or extend from a lower region of face plate 152. Additionally, in the illustrated embodiment, angle γ is an obtuse angle such that support tabs 162, 164 extend upwardly from back surface 156 of tray-tag 150. With mounting assembly 158 configured in this manner, tray-tag 150 can be readily attached to a tray 104. In particular, to attach tray-tag 150 to a tray 104, a user positions tray-tag 150 such that engagement flap 160 extends over rim 132 and support tabs 162, 164 rest on top of rim 132. With tray-tag 150 so positioned, the user simply applies a downward force to tray-tag 150 to cause mounting assembly 158 to couple to tray 104. More specifically, when the user applies the downward force to tray-tag 150, support tabs 162, 164 flex in a generally counterclockwise direction, as illustrated by arrow 166, so allow rim 132 to be inserted between engagement flap 160 and support tabs 162, 164. Once rim 132 is so positioned, support tabs 162, 164 return to the illustrated position to retain rim 132 within the discontinuous channel formed by support tabs 162, 164 and engagement flap 160. Support tabs 162, 164 are thus able to selectively secure tray-tag 150 to tray 104. Additionally, the illustrated configuration of support tabs 162, 164 enables support tabs 162, 164 to maintain face plate 152 in a generally vertical orientation when tray-tag 150 is coupled to tray 104.

Like mounting assembly 112, mounting assembly 158 can extend from or be positioned on face plate 152 so that face plate 152 will be desirably positioned relative to rim 132 when tray-tag 150 is coupled to tray 104. For instance, as discussed herein, it may be desirable for face plate 152 not to extend to far above or below rim 132. Accordingly, mounting assembly 158 may be arranged on face plate 152 so that face plate 152 is positioned immediately adjacent rim 132. This can be accomplished by positioning mounting assembly 158 on face plate 152 so that mounting assembly 158 (or a central longitudinal axis of mounting assembly 158) is substantially within a generally horizontal projection of face plate 152 when face plate 152 is in a generally vertical orientation. As illustrated in FIG. 10, for example, mounting assembly 158 (and longitudinal axis A thereof) is positioned between horizontal projection lines HP of face plate 152. As a result, face plate 152 is held immediately adjacent to and generally vertically aligned with rim 132 so that face plate 152 does not extend too far above or below rim 132.

In addition to the possibility of altering the position or orientation of the engagement flap or the support tabs on the back surface of the face plate, the engagement flap and the support tabs may be attached to or extend from other areas of the face plate. For instance, FIGS. 11 and 12 illustrate exemplary embodiments of tray-tags according to the present invention in which the engagement flap and the support tabs extend from the top and bottom, respectively, of the face plate rather than the back surface of the face plate.

Figure 11:
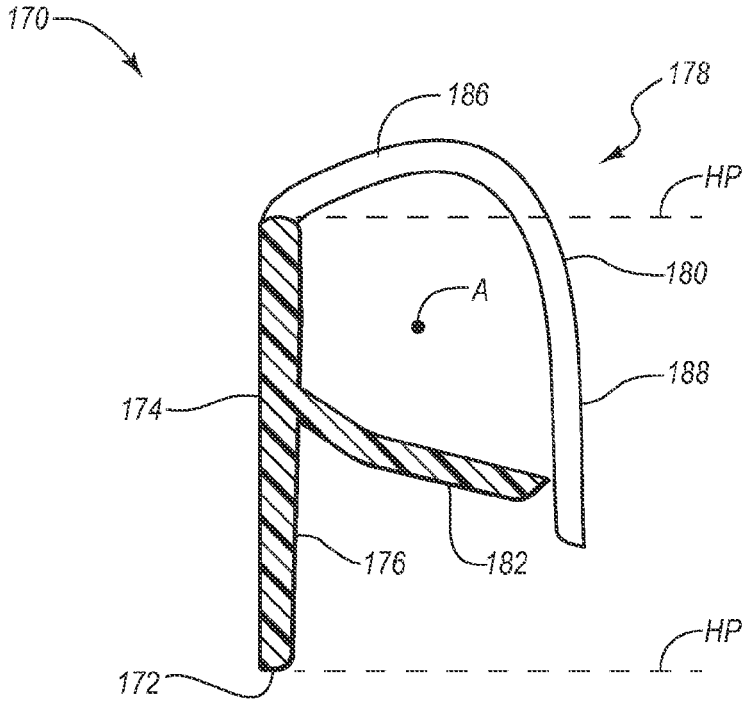
FIG. 11 is a partial cross-sectional end view of another embodiment of a tray-tag according to the present invention.
Figure 12:
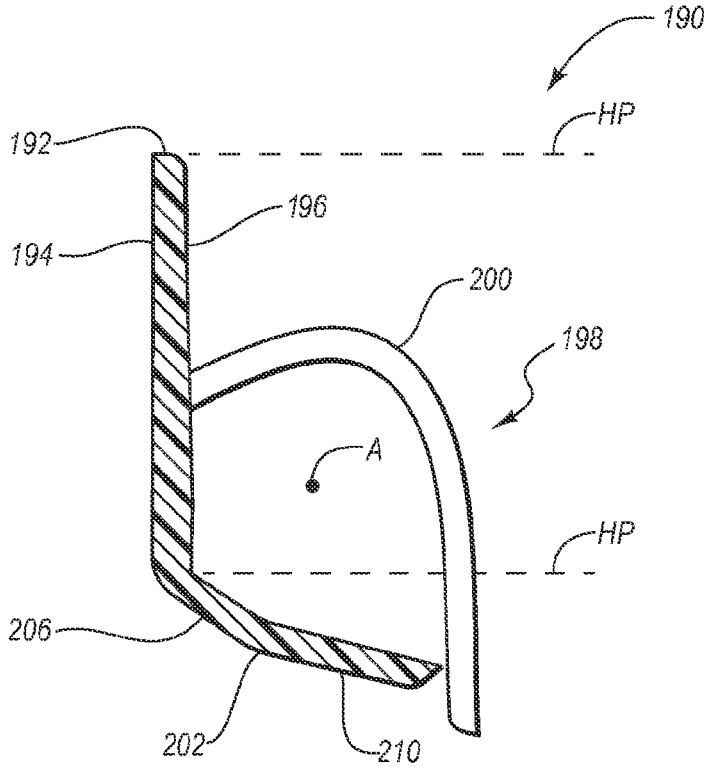
FIG. 12 is a partial cross-sectional end view of yet another embodiment of a tray-tag according to the present invention.

With specific reference to FIG. 11, a tray-tag 170 is illustrated. Tray-tag 170 includes a face plate 172 having a labeling surface 174 and a back surface 176. Labeling surface 174 can include indicia thereon for providing information about items placed on a tray 104 associated with tray-tag 170. Similar to the other tray-tags disclosed herein, tray-tag 170 includes a mounting assembly 178. In the illustrated embodiment, mounting assembly 178 includes an engagement flap 180 and support tabs 182, 184 (support tab 184 not shown) that are similar to engagement flap 122 and support tabs 124, 126, as described above. Engagement flap 180 and support tabs 182, 184 are shaped to generally correspond to the shape of rim 132 of tray 104. Support tabs 182, 184 extend from back surface 176 of face plate 172. As described above, support tabs 182, 184 can extend from various vertical positions on back surface 176 or at various angles relative to back surface 176.

Engagement flap 180 is similar to engagement flap 122 described above. Specifically, engagement flap 180 includes a first portion 186 and a second portion 188. First portion 186 extends away from face plate 172 so as to be able to extend over the top of rim 132 of tray 104. Second portion 188 extends generally downward from first portion 186 so as to extend at least partially down an interior wall surface of tray 104. Rather than extending from the back surface of the face plate like engagement flap 122, engagement flap 180 extends from the top of face plate 172. It will be appreciated, however, that engagement flap 180 may extend from the top surface, the bottom surface, the back surface, the front surface, or an end surface of face plate 172 without departing from the scope of the present invention.

Mounting assembly 178 can extend from or be positioned on face plate 172 so that face plate 172 will be desirably positioned relative to rim 132 when tray-tag 170 is coupled to tray 104. For instance, as discussed herein, it may be desirable for face plate 172 not to extend to far above or below rim 132. Accordingly, mounting assembly 178 may be arranged on face plate 172 so that face plate 172 is positioned immediately adjacent rim 132. This can be accomplished by positioning mounting assembly 178 on face plate 172 so that mounting assembly 178 (or a central longitudinal axis of mounting assembly 178) is substantially within a generally horizontal projection of face plate 172 when face plate 172 is in a generally vertical orientation. As illustrated in FIG. 11, for example, mounting assembly 178 (and central longitudinal axis A thereof) is substantially positioned between horizontal projection lines HP of face plate 172. As a result, face plate 172 is held immediately adjacent to and generally vertically aligned with rim 132 so that face plate 172 does not extend too far above or below rim 132. Nevertheless, as shown in FIG. 11, a portion of mounting assembly 178 may extend beyond or outside horizontal projection lines HP while still being considered to be substantially between horizontal projection lines HP.

With specific reference to FIG. 12, a tray-tag 190 is illustrated. Tray-tag 190 includes a face plate 192 having a labeling surface 194 and a back surface 196. Labeling surface 194 can include indicia thereon for providing information about items placed on a tray 104 associated with tray-tag 190. Similar to the other tray-tags disclosed herein, tray-tag 190 includes a mounting assembly 198. In the illustrated embodiment, mounting assembly 198 includes an engagement flap 200 and support tabs 202, 204 (support tab 204 not shown) that are similar to engagement flap 122 and support tabs 124, 126, as described above. Engagement flap 220 and support tabs 202, 204 are shaped to generally correspond to the shape of rim 132 of tray 104. Engagement flap 200 extends from back surface 196 of face plate 192. As described above, engagement flap 200 can extend from various vertical positions on back surface 196 or at various angles relative to back surface 196.

Support tabs 202, 204 are similar to support tabs 124, 126 described above. Specifically, support tabs 202, 204 include first portions 206, 208, respectively (first portion 208 not shown) and second portions 210, 212 (second portion 212 not shown), respectively, that extend from first portions 206, 208. Support tabs 202, 204 extend away from face plate 192 so as to be able to extend under the bottom of rim 132 of tray 104. Rather than extending from the back surface of the face plate like support tabs 124, 126, support tabs 204, 204 extend from the bottom of face plate 192. It will be appreciated, however, that support tabs 204, 204 may extend from the top surface, the bottom surface, the back surface, the front surface, or an end surface of face plate 192 without departing from the scope of the present invention.

Mounting assembly 198 can extend from or be positioned on face plate 192 so that face plate 192 will be desirably positioned relative to rim 132 when tray-tag 190 is coupled to tray 104. For instance, as discussed herein, it may be desirable for face plate 192 not to extend to far above or below rim 132. Accordingly, mounting assembly 198 may be arranged on face plate 192 so that face plate 192 is positioned immediately adjacent rim 132. This can be accomplished by positioning mounting assembly 198 on face plate 192 so that mounting assembly 198 (or a central longitudinal axis of mounting assembly 198) is substantially within a generally horizontal projection of face plate 192 when face plate 192 is in a generally vertical orientation. As illustrated in FIG. 12, for example, mounting assembly 198 (and central longitudinal axis A thereof) is substantially positioned between horizontal projection lines HP of face plate 192. As a result, face plate 192 is held immediately adjacent to and generally vertically aligned with rim 132 so that face plate 192 does not extend too far above or below rim 132. Nevertheless, as shown in FIG. 12, a portion of mounting assembly 198 may extend beyond or outside horizontal projection lines HP while still being considered to be substantially between horizontal projection lines HP.

Accordingly, as described herein and illustrated in the Figures, a tray-tag according to exemplary embodiments of the present invention may include a mounting assembly that is substantially within a horizontal projection of the face plate when the place plate is in a vertical orientation. Likewise, a mounting assembly may have a central longitudinal axis that is substantially within a horizontal projection of the face plate when the place plate is in a vertical orientation. Additionally, a mounting assembly may be configured to couple to a rim of a tray so that the rim of the tray is substantially within a horizontal projection of the face plate when the place plate is in a vertical orientation and when the tray-tag is coupled to the rim of the tray. Similarly, a mounting assembly may be configured to couple to a rim of a tray so that a longitudinal axis (e.g., a central longitudinal axis) of the rim is substantially within a horizontal projection of the face plate when the place plate is in a vertical orientation and when the tray-tag is coupled to the rim of the tray.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A tray-tag adapted to be selectively and securely coupled to a rim of a tray for providing information about items on the tray, the rim of the tray being disposed along a top portion of a tray wall that has interior and exterior surfaces, the tray-tag comprising:

a face plate having a front surface and a back surface, the front surface being adapted to have indicia thereon for providing information about items on the tray;

a mounting assembly extending from the face plate and being adapted to selectively and securely couple the tray-tag to the rim of the tray so that the rim of the tray is positioned adjacent to the face plate and generally within a horizontal projection of the face plate when the tray-tag is coupled to the tray, the mounting assembly comprising;

an engagement flap comprising a first portion that extends distally and generally perpendicularly from the face plate so that the first portion extends over a top of the rim and a second portion that extends generally downwardly from the first portion so that the second portion extends along a portion of the interior surface of the tray wall;

a first support tab disposed adjacent a first end of the engagement flap, wherein the first support tab extends distally and generally perpendicularly from the face plate so that the first support tab extends underneath the rim of the tray;

a second support tab disposed adjacent a second end of the engagement flap such that the first support tab and the second support tab are spaced apart from one another and such that the engagement flap is disposed between the first support tab and the second support tab, wherein the second support tab extends distally and generally perpendicularly from the face plate so that the second support tab extends underneath the rim of the tray.

2. The tray-tag of claim 1, wherein the engagement flap extends from a top surface of the face plate.

3. The tray-tag of claim 1, wherein the engagement flap extends from the back surface of the face plate.

4. The tray-tag of claim 1, wherein the first support tab extends from a bottom surface of the face plate.

5. The tray-tag of claim 1, wherein the first support tab extends from the back surface of the face plate.

6. The tray-tag of claim 1, wherein the first support tab and the second support tab each comprises a first end and an opposing second end, wherein the opposing second ends of the first support tab and the second support tab terminate at the interface between the rim and the wall of the tray when the tray-tag is selectively coupled to the tray, whereby the face plate is substantially prevented from rotating about the rim of the tray.

7. The tray-tag of claim 1, wherein the first and second support tabs are adapted to maintain the face plate in a generally vertical position when said tray-tag is coupled to said tray.

8. The tray-tag of claim 1, wherein the engagement flap and the first and second support tabs form a discontinuous channel along the back surface of the face plate, the discontinuous channel having a central longitudinal axis that is generally aligned with a central longitudinal axis of said rim of said tray when said tray-tag is coupled to said rim.

9. The tray-tag of claim 8, wherein the discontinuous channel formed by the engagement flap and the first and second support tabs has a cross-sectional geometry that generally corresponds to a cross-sectional geometry of said rim of said tray, wherein said tray-tag is coupled to said tray so that said rim is positioned within the discontinuous channel.

10. A storage system for storing and providing information about items, the storage system comprising:

a tray upon which items can be placed for storage, the tray comprising a wall and a rim formed on the wall such that there is an interface between the rim and the wall; and a tray-tag adapted to be selectively and securely coupled to the tray, the tray-tag comprising:

a face plate having a front surface and a back surface, the front surface being adapted to have indicia thereon for providing information about items on the tray;

a mounting assembly associated with the face plate and being configured to selectively and securely couple the face plate to the rim of the tray, the mounting assembly having a central longitudinal axis that is substantially within a horizontal projection of the face plate when the face plate is in a generally vertical orientation, the mounting assembly comprising:

an engagement flap having a first portion that extends distally and generally perpendicularly from the face plate so as to extend over a top of the rim of the tray and a second portion that extends along a portion of an interior surface of the wall of the tray when the tray-tag is selectively coupled to the tray; and a first support tab extending distally from the face plate so as to extend underneath the rim of the tray, the first support tab comprising a first end and an opposing second end, the opposing second end of the first support tab terminating at the interface between the rim and the wall of the tray when the tray-tag is selectively coupled to the tray; and a second support tab spaced apart from the first support tab such that the engagement flap is disposed between the first support tab and the second support tab, the second support tab extending distally from the face plate so as to extend underneath the rim of the tray, the second support tab comprising a first end and an opposing second end, the opposing second end of the second support tab terminating at the interface between the rim and the wall of the tray when the tray-tag is selectively coupled to the tray, wherein the first support tab and the second support tab cooperate to substantially prevent the face plate from rotating about the rim of the tray.

11. The storage system of claim 10, wherein the engagement flap enables selective coupling and decoupling between the tray-tag and the tray.

12. The storage system of claim 11, wherein the first support tab and the second support tab further enable selective coupling and decoupling between the tray-tag and the tray.

13. The storage system of claim 10, wherein the engagement flap extends from a top surface of the face plate.

14. The storage system of claim 10, wherein the engagement flap extends from a back surface of the face plate.

15. The storage system of claim 10, wherein the first support tab and the second support tab extend from a bottom surface of the face plate.

16. The storage system of claim 10, wherein the engagement flap, the first support tab, and the second support tab are disposed substantially within the horizontal projection of the face plate when the face plate is in a generally vertical orientation.

17. A food storage system, comprising:

a shelving assembly having a plurality of shelves arranged to form a plurality of slots therebetween;

a tray upon which food can be placed, wherein tray is adapted to be received within one of the plurality of slots of the shelving assembly, the tray comprising a base, a wall extending from the base, and a rim formed on the wall such that there is an interface between the rim and the wall; and a tray-tag having a face plate and a mounting assembly, wherein the mounting assembly is adapted to couple the face plate to the rim of the tray, wherein the mounting assembly is arranged on the face plate such that the rim of the tray is substantially disposed within a horizontal projection of the face plate to enable the tray and the tray-tag to be received within one of the plurality of slots without the tray-tag engaging one or more of the plurality of shelves, the mounting assembly comprising:

an engagement flap having a first portion that extends distally and generally perpendicularly from the face plate so that the first portion extends over a top of the rim of the tray and a second portion that extends generally downwardly from the first portion so that the second portion extends along a portion of an interior surface of the wall of the tray;

a first support tab disposed adjacent a first end of the engagement flap, wherein the first support tab extends distally and generally perpendicularly from the face plate so that the at least one support tab extends underneath the rim of the tray and terminates at the interface between the rim and the wall;

a second support tab disposed adjacent a second end of the engagement flap such that the first support tab and the second support tab are spaced apart from one another and such that the engagement flap is disposed between the first support tab and the second support tab, wherein the second support tab extends distally and generally perpendicularly from the face plate so that the at least one support tab extends underneath the rim of the tray and terminates at the interface between the rim and the wall, wherein the first support tab and the second support tab cooperate to substantially prevent rotation of the face plate about the rim of the tray.

18. The food storage system of claim 17, wherein the first support tab and the second support tab extend from a bottom surface of the face plate.

19. The food storage system of claim 17, wherein the engagement flap extends from a top surface of the face plate.

20. The food storage system of claim 17, wherein at least one of the engagement flap and the first and second support tabs extend from a back surface of the face plate and at least one of the engagement flap and the first and second support tabs extend from a top or bottom surface of the face plate.

* * * * *